United States Patent [19]

Simonazzi

[11] Patent Number: 4,653,249

[45] Date of Patent: Mar. 31, 1987

[54] TELESCOPIC FILLING ADAPTER FOR BOTTLE FILLING MACHINES

[76] Inventor: Andriano Simonazzi, Via Laspezia 247/A, 43016 Parma, Italy

[21] Appl. No.: 782,817

[22] Filed: Oct. 2, 1985

[30] Foreign Application Priority Data

Oct. 2, 1984 [IT] Italy ..... 3587 A/84

[51] Int. Cl.[4] ..... B65B 39/12

[52] U.S. Cl. ..... 53/273; 53/272; 141/387

[58] Field of Search ..... 53/273, 272, 329; 141/387, 388

[56] References Cited

U.S. PATENT DOCUMENTS

| | | | |
|---|---|---|---|
| 931,649 | 8/1909 | Redington | 53/272 X |
| 1,179,372 | 4/1916 | Hendrickson | 53/273 |
| 1,237,038 | 8/1917 | Hendrickson | 53/273 |
| 1,668,264 | 5/1928 | Calleson | 53/272 X |

*Primary Examiner*—James F. Coan

*Attorney, Agent, or Firm*—Sughrue, Mion, Zinn, Macpeak, and Seas

[57] ABSTRACT

A telescopic filling adapter of the type adapted to be mounted on the filling valve of a bottle filling machine is comprised of a mounting element adapted to be sealingly engaged with the filling valve. A centering element is provided with an annular seal for engaging a bottle opening and is mounted for telescopic sliding movement relative to the mounting element. One of the elements defines an annular telescopic chamber for slidably receiving the other element with sufficient clearance to permit the passage of fluid into the telescopic chamber during a bottle filling operation. A sealing ring is provided between the mounting element and the centering element so that the telescopic chamber may be pressurized when the mounting element is sealingly engaged with the filler valve and the centering element is sealingly engaged with a bottle. Suitable springs are provided for biasing the centering element into pressure engagement with the bottle.

1 Claim, 12 Drawing Figures

TELESCOPIC FILLING ADAPTER FOR BOTTLE FILLING MACHINES

BACKGROUND OF THE INVENTION

The present invention is directed to a telescopic filling adapter for a bottle filling machine and more specifically to a two piece telescopic adapter designed to be secured to the lower end of a filling valve of a bottle filling machine and resiliently engageable with the neck of a bottle being filled to prevent damage to light weight plastic bottles during an automatic bottle filling operation.

Most bottle filling machines are provided with a rotatable bottle supporting member for indexing the bottles past a filling station. At each filling station an extendable cylinder is adapted to raise the bottle into engagement with a filler valve on the automatic bottle filling machine. In the past the filling valve was provided with a rigid one piece cup which applied pressure on the neck of the bottle. While glass bottles had sufficient strength to resist the pressure, the pressure has generally proven to be too great for the softer structure of plastic bottles. Accordingly plastic bottles have been subjected to deformation which renders the bottles unacceptable for sealing.

SUMMARY OF THE INVENTION

The present invention provides a new and improved telescopic filling adapter which is to be mounted on the lower end of the filling valve in lieu of the rigid one piece plastic cup to accommodate plastic bottles as well as glass bottles without subjecting the plastic bottles to undue deformation forces.

The present invention provides a new and improved telescopic filling adapter comprising a mounting element adapted to sealingly engage the filling valve, a centering cup having sealing means for engaging the bottle opening mounted for telescopic sliding movement relative to the mounting element, telescopic passage means formed on said mounting element and centering cup, sealing means between said mounting element and said centering cup and spring means interposed between said mounting element and said centering cup for normally biasing said mounting element and said centering cup apart from each other. The telescopic filling adapter according to the present invention is designed for a two phase operation. During the first phase the upward movement of a bottle to be filled will bring the opening of the bottle into sealing engagement with the centering cup and move the centering cup upwardly against the force of the spring means which will yield to prevent damage to the bottle, but which is strong enough to insure a seal between the bottle opening and the centering cup thereby allowing the start of the "gas phase" of the filling process. During the "liquid phase" of the filling process the sealing condition between the bottle and the centering cup is enhanced due to the compression of the gas which has penetrated into the telescopic chamber formed between the mounting element and the centering cup.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
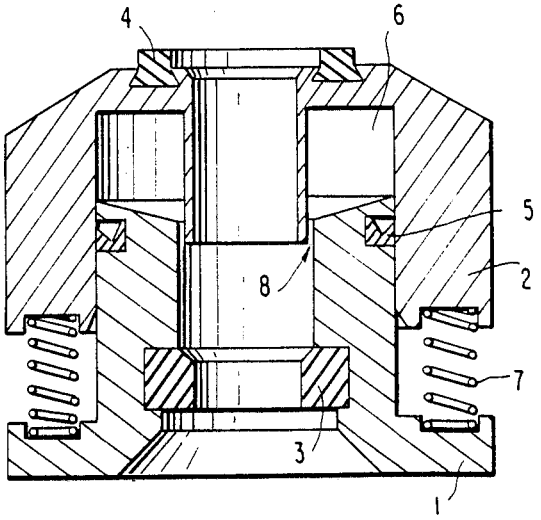
FIG. 1 is a sectional view of a two phase telescopic filling adapter according to a first embodiment with a sealing ring mounted on the inner mobile lower element.

In the first four embodiments of the present invention as illustrated in FIGS. 1–8, the telescopic filling adapter is comprised of an outer element adapted to be fixedly secured to the filling apparatus or filling valve of a conventional bottle filling machine. An annular gasket 4 is mounted on the upper end of the outer element 2 about a central passage in the form of a concentric sleeve which extends downwardly within the outer member 2 to define an annular chamber 6 adapted to telescopically receive the moveable lower element 1. Sufficient clearance is provided between the concentric sleeve defining the fluid passage in the outer member and the fluid passage in the inner member to define an annular passage 8 which will allow the passage of gas into the chamber 6 during the "gas phase" of the filling operation. An annular seal 3 is mounted in the fluid passage of the inner member 1 and is adapted to sealingly engage the upper end of the bottle opening (not shown). In all four embodiments a sealing ring 5 is provided between the inner and outer telescopic members. As shown in FIGS. 1, 3, 5, and 7, the sealing ring is mounted in an annular groove formed in the outer surface of the inner member 1 and in FIGS. 2, 4, 6, and 8, the sealing member 5 is mounted in an annular groove formed in the inner surface of the outer fixed member 2.

Figure 2:
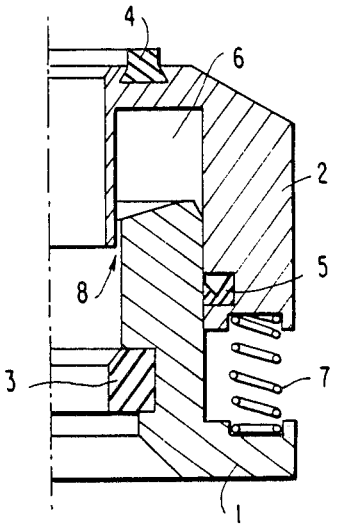
FIG. 2 is a partial sectional view similar to FIG. 1 but with the sealing ring mounted on the outer fixed upper element.

In a first embodiment, as shown in FIGS. 1 and 2, a plurality of coil springs 7 are equally spaced in a circle between the lower end of the outer fixed element 2 and an annular flange extending outwardly from the bottom of the inner moveable element 1.

Figure 3:
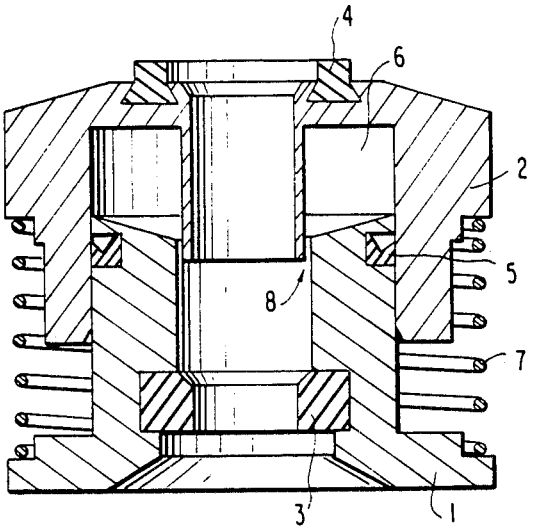
FIG. 3 is a sectional view of a two phase telescopic filling adapter according to a second embodiment with a sealing ring mounted on the inner mobile lower element.
Figure 4:
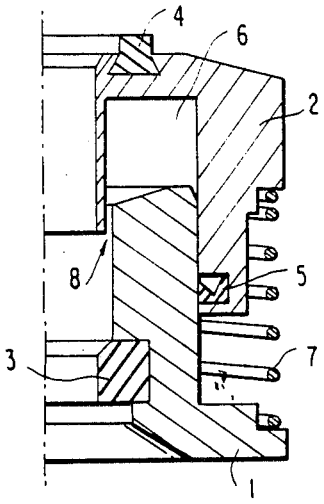
FIG. 4 is a partial sectional view similar to FIG. 3 with the sealing ring mounted on the outer fixed upper element.

In the second embodiment, as shown in FIGS. 3 and 4, a single coil spring 7 surrounds the inner and outer elements 1 and 2 and engages opposed flanges on the inner and outer elements 1 and 2 to normally bias the elements apart.

Figure 5:
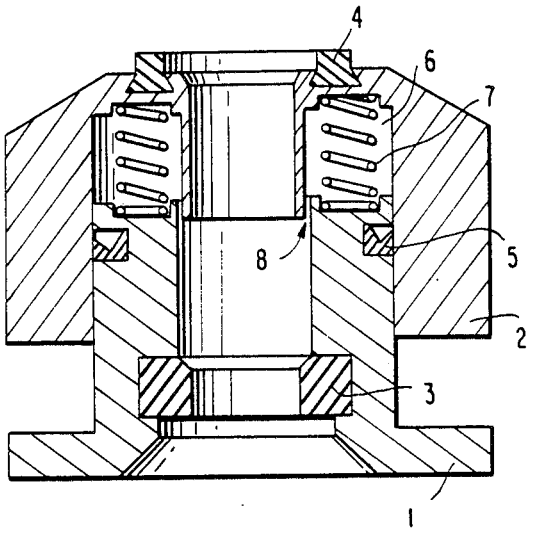
FIG. 5 is a sectional view of a two phase telescopic filling adapter according to a third embodiment with the sealing ring mounted on the inner mobile lower element.
Figure 6:
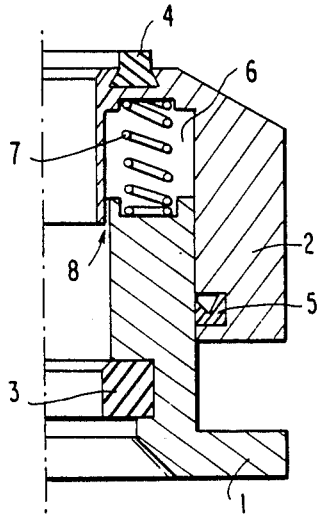
FIG. 6 is a partial sectional view similar to FIG. 5 with the sealing ring mounted on the outer fixed upper element.

In the third embodiment, as shown in FIGS. 5 and 6, a plurality of coil springs 7 are disposed in equally spaced apart relation in the annular telescopic chamber 6 between the bottom of the chamber 6 in the fixed element 2 and the upper end of the moveable element 1 to normally bias the elements apart.

Figure 7:
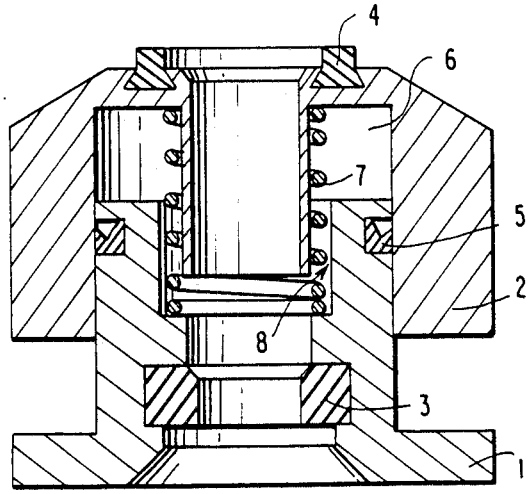
FIG. 7 is a sectional view of a two phase telescopic filling adapter according to a fourth embodiment with the sealing ring mounted on the inner mobile lower element.
Figure 8:
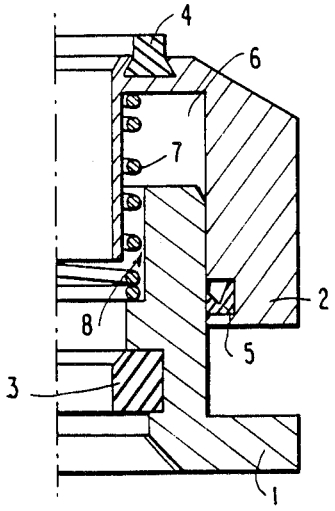
FIG. 8 is a partial sectional view similar to FIG. 7 with a sealing ring mounted on the outer fixed upper element.

In the fourth embodiment, as shown in FIGS. 7 and 8, the single coil spring 7 surrounds the concentric sleeve in engagement with the bottom of the chamber 6 in the fixed outer element 2 and a flange on the moveable inner element 1 to normally bias the elements apart.

Figure 9:
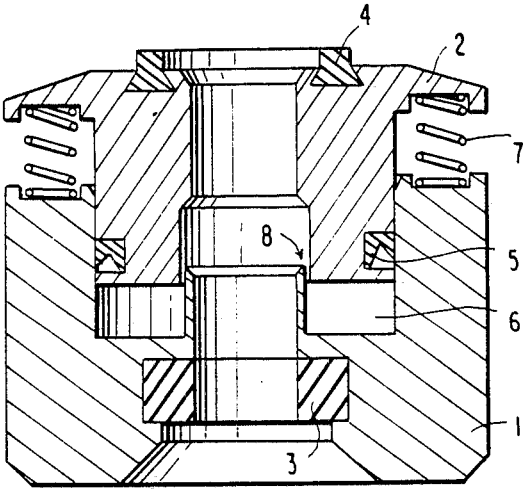
FIG. 9 is a sectional view of a two phase telescopic filling adapter according to the fifth embodiment of the present invention with the sealing ring mounted on the inner fixed upper element.
Figure 10:
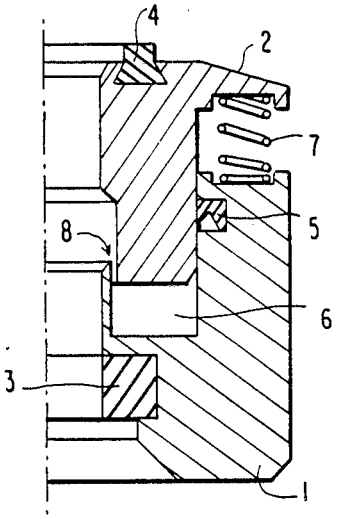
FIG. 10 is a partial sectional view similar to FIG. 9 with the sealing ring mounted on the outer mobile lower element.
Figure 11:
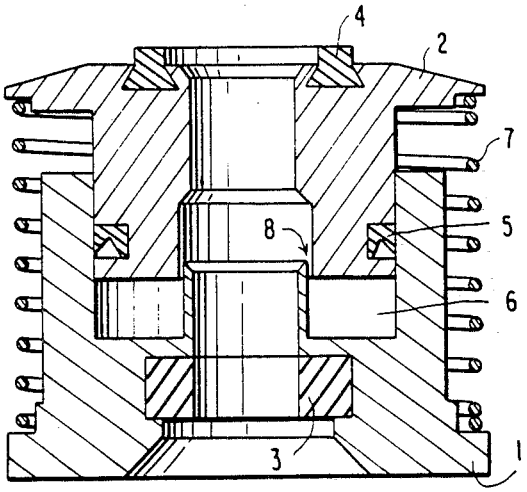
FIG. 11 is a sectional view of a two phase telescopic filling adapter according to a sixth embodiment of the present invention with the sealing ring mounted on the inner fixed upper element.

The construction of the telescopic filling adapter as illustrated in FIGS. 9–12 is substantially reversed from the arrangement shown in FIGS. 1–8. According to the modified construction as shown in FIGS. 9–12 the fixed member 2 is now the inner telescopic member and the moveable member 1 is the outer telescopic element. The fixed inner element 2 is provided with an annular gasket 4 surrounding the central fluid passage which extends therethrough. The moveable outer element 1 is provided with a central fluid passage partially defined by a concentric sleeve extending upwardly into telescopic relation with the passage in the fixed element 2. As in the previous arrangement clearance is provided between the telescopic sleeve on the moveable element 1 and the fluid passage in the fixed element 2 to define an annular passage 8 for the flow of gas into an annular telescopic chamber 6 during the "gas phase" of the filling operation. An annular sealing member 3 is provided in the passage of the lower moveable member and a sealing ring is provided between the inner and outer telescopic members. In FIGS. 9 and 11 the sealing ring 5 is located in a groove in the outer surface of the inner fixed element and in FIGS. 10 and 12 the sealing ring is located in an annular groove formed in an inner surface of the outer moveable element 1. In the embodiment of FIGS. 9 and 10 a plurality of coil springs 7 are equally spaced about the fixed member 2 and extend between an annular flange on the fixed member 2 and the upper end of the moveable element 1 to normally bias the elements apart.

Figure 12:
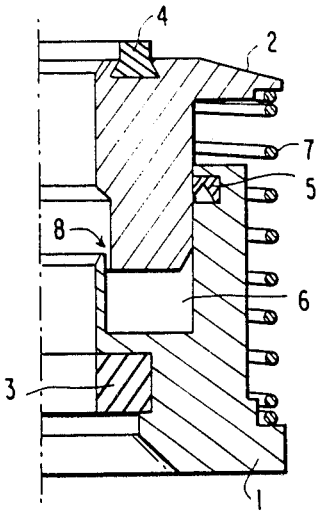
FIG. 12 is a partial sectional view similar to FIG. 11 with the sealing ring mounted on the outer mobile lower element.

In the embodiment of FIGS. 11 and 12 a single coil spring is provided which extends about the inner and outer telescopic elements between opposed flanges thereon to normally bias the elements apart.

In the operation of the telescopic filling adapter according to all of the embodiments, the upward movement of a bottle to be filled will cause the upper end of the bottle surrounding the opening to engage the seal member 3 and move the lower telescopic member upwardly relative to the fixed element against the force of the spring means 7. Due to the presence of the spring means 7 excessive force will not be applied against the top of the bottle which would damage the bottle in any way. Once the bottle is in sealing engagement with the seal 3 a two phase filling operation begins. During the "gas phase" gas is introduced through the passages in the inner and outer telescopic elements into the bottle. The gas will also pass through the annular passage 8 into the telescopic chamber 6. The gas pressure in the telescopic chamber 6 will provide an added compressive downwardly directed force to enhance the seal between the seal member 3 and the top of the bottle. The "liquid phase" then commences to fill the bottle with the desired liquid. Upon lowering of the filled bottle the spring means 7 will act to move the upper and lower telescopic elements away from each other. Suitable means may be provided on the filling machine to prevent the complete separation of the upper and lower elements.

While the invention has been particularly shown and described with reference to preferred embodiments thereof it will be understood by those in the art that the foregoing and other changes in form and details may be made therein without departing from the spirit and scope of the invention.

What is claimed is:

1. A telescopic filling adapter for a bottle filling machine comprising a mounting element adapted to sealingly engage a filling valve, a centering element having sealing means for engaging the neck of a bottle, sleeve means on one of said elements defining an annular chamber in which the other of said elements is slidably disposed for telescopic sliding movement relative to said one of said elements, telescopic fluid passage means formed between said sleeve means and the other of said elements, sealing means between said mounting element and said centering element and spring means interposed between said mounting element and said centering element for normally biasing said mounting element and said centering element apart from each other to press said sealing means on said centering element into sealing engagement with said bottle neck.

* * * * *